US006803935B2

(12) United States Patent
Chien et al.

(10) Patent No.: US 6,803,935 B2
(45) Date of Patent: Oct. 12, 2004

(54) METHOD FOR GENERATING A WATERMARK ON A PHOTO PICTURE USING A THERMAL PRINTER

(75) Inventors: Hsu-Chu Chien, Taipei (TW); Kuan-Chih Huang, Taipei Hsien (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 0 days.

(21) Appl. No.: 10/063,886

(22) Filed: May 21, 2002

(65) Prior Publication Data

US 2003/0152408 A1 Aug. 14, 2003

(30) Foreign Application Priority Data

Feb. 8, 2002 (TW) ..... 91102550 A

(51) Int. Cl.[7] ..... B41J 2/315
(52) U.S. Cl. ..... 347/212
(58) Field of Search ..... 347/212, 174, 347/178, 172, 188, 173, 171; 400/120.18, 120.07, 237, 240, 240.4, 241, 242

(56) References Cited

U.S. PATENT DOCUMENTS 6,130,698 A * 10/2000 Katsuda et al. ..... 347/212
6,509,920 B2 * 1/2003 Sung et al. ..... 347/178

* cited by examiner

*Primary Examiner*—K. Feggins
(74) *Attorney, Agent, or Firm*—Winston Hsu

(57) ABSTRACT

A method for generating a watermark on a photo picture using a thermal printer. The thermal printer includes a thermal printhead for heating an ink ribbon and sublimating color dyes stored in the ink ribbon on a photo picture. The ink ribbon includes a plurality of sequentially arranged color frames. Each color frame includes a plurality of dye frames with different color dyes and a dye frame with overcoating. The method includes using the thermal printhead to heat a color frame with a plurality of different color dyes and to sublimate the color dyes on a photo picture and using the thermal printhead to heat the dye frame with the overcoating and to heat different areas on the color frame by two distinct time periods.

3 Claims, 10 Drawing Sheets

Happy New Year Happy New
Year Happy New Year Happy
New Year Happy New Year H
Happy New Year Happy New
Year Happy New Year Happy
New Year Happy New Year H
Happy New Year Happy New
Year Happy New Year Happy
New Year Happy New Year H
Happy New Year Happy New
Year Happy New Year Happy
New Year Happy New Year H
Happy New Year Happy New

Fig. 7

METHOD FOR GENERATING A WATERMARK ON A PHOTO PICTURE USING A THERMAL PRINTER

BACKGROUND OF INVENTION

1. Field of the Invention

The present invention relates to a method for generating an image on a photo picture using a thermal printer, and more particularly, to a method for generating a watermark on a photo picture using a thermal printer.

2. Description of the Prior Art

A processed image in a digital camera can usually be stored in two ways; one is to store it into memory, the other is to print a photo picture with a thermal printer. Just as some letters have watermarks to provide hidden information, patterns can be printed on conventional photo pictures, such as a pearl photo picture, shown in FIG. 1.

Please refer to FIG. 2. FIG. 2 is a function block diagram of a color frame positioning system 10 of a thermal printer (not shown) according to a prior art. The color frame positioning system 10 comprises an ink ribbon 18 windably installed inside a ribbon cartridge (not shown). FIG. 3 is a schematic diagram of the ink ribbon 18 of the color frame positioning system 10 shown in FIG. 2. The ink ribbon 18 comprises a plurality of sequentially arranged color frames. Each color frame comprises four dye frames 20, 22, 24, and 26 for separately storing yellow, magenta, cyan, and an overcoating dye. The color frame positioning system 10 also comprises a thermal printhead 12, a winding mechanism 14, a controller 16, an optical sensor 30, a light source 32, and an identification device 38. The winding mechanism 14 drives each dye frame passing through the thermal printhead 12. The light source 32 is installed on the same side as the ink ribbon 18 for generating a predetermined color light beam 34 to project on the ink ribbon 18. The optical sensor 30 is installed on the opposite side to the ink ribbon 18 for detecting light beams 36 passed through the ink ribbon 18 and for generating corresponding sensing voltages. The identification device 38 identifies the position of the dye frame 20, 22, 24, 26 of the ink ribbon 18 by determining the sensing voltages generated by the optical sensor 30. The controller 16 administers the operations of the winding mechanism 14 and the print procedures for the thermal printer on a photo picture by determining position signals provided by the identification device 38.

The light beam 34 generated from the light source 32 has a different penetration rate for each dye frame of a color frame. Therefore, when two adjacent dye frames pass by the optical sensor 30 sequentially, the optical sensor 30 will generate different sensing voltages. The identification device 38 identifies the position of the color frame, the dye frames of the color frame, and generates corresponding position signals by determining the sensing voltages generated by the optical sensor 30. The controller 16 controls the winding mechanism 14 to wind the ink ribbon 18 and causes the ink ribbon 18 to pass through the thermal printhead 12 according to the position signals generated by the identification device 38. The thermal printhead 12 generates heat and sublimates the dyes stored in the ink ribbon 18 onto photo paper. Finally, the thermal printhead 12 heats the dye frame storing the overcoating for a single time period to form a single-thickness overcoating to attain waterproofing and light-resistance effects.

Please refer to FIG. 4. FIG. 4 is a schematic diagram of a visual effect as seen by eyes 49 sensing light beams reflected by a photo picture 40 without an overcoating. A first incident light beam 42 is parallel to a second incident light beam 44 and a first reflected light beam 46 is parallel to a second reflected light beam 48. The above four light beams are not perpendicular to the photo picture 40. The two mutually parallel reflected light beam 46, 48 are exactly the two light beams that are projected from the two mutually parallel incident light beams 42, 44 on the photo picture 40 and reflected by the photo picture 40. Therefore, the image on the photo picture 40, as seen by the eyes 49 when the two incident light beams 42, 44 are not perpendicular to the photo picture 40, is identical to that when the two incident light beams 42, 44 are perpendicular to the photo picture 40.

Please refer to FIG. 5. FIG. 5 is a schematic diagram of a visual effect as seen by eyes 59 sensing light beams projected on a photo picture 50 with a single-thickness overcoating 51. A first incident light beam 52 is parallel to a second incident light beam 54 and a first reflected light beam 56 is parallel to a second reflected light beam 58. The above four light beams are not perpendicular to the photo picture 50. Two dotted lines, shown in FIG. 5, are the paths of two reflected light beams that are projected on the photo picture 50 from the two incident light beams 52, 54 and reflected by the photo picture 50 if the photo picture 50 does not have any overcoating 51. A P1 and a P2 are the two reflecting points for the two incident light beams 52, 54 if the photo picture 50 does not have any overcoating 51. The incident light beams 52, 54 projected on the photo picture 50 with a single-thickness overcoating 51 are reflected by the photo picture 50 as the mutually parallel reflected light beams 56, 58. A P3 and a P4 are the two perceived reflecting points for the two incident light beams 52, 54 as seen by the eyes 59 if the photo picture 50 has the single-thickness overcoating 51.

The locational shift occurring between the points P3 and P1 is the same as that between the points P4 and P2 on the photo picture 50 having the single-thickness overcoating 51. Therefore, the image on the photo picture 50 as seen by the eyes 59 when the two incident light beams 52, 54 are not perpendicular to the photo picture 50 is identical to that when the two incident light beams 52, 54 are perpendicular to the photo picture 50. A single-thickness overcoating 51 provides no perceptual change in the image.

As illustrated in FIG. 5, a photo picture with a single-thickness overcoating only protects the photo without effectively altering the photo. This single protection effect performed by a thermal printer on a photo picture cannot compete with a variety of special effects, such as a watermark or other special visual effects, which are available through conventional skill on a conventional photo picture. When special visual effects are desired on a photo picture, a thermal printer is unable to meet the need, forcing users to turn to conventional photo pictures. The inability of a thermal printer to provide visual special effects on a printed photo picture retards sales and development of thermal printers.

SUMMARY OF INVENTION

It is therefore a primary objective of the claimed invention to provide a method for generating not only a dual-thickness overcoating on a photo picture, but a variety of specially designed patterns on a printed photo picture.

According to the claimed invention, a thermal printer includes a thermal printhead for heating an ink ribbon and sublimating color dyes stored in the ink ribbon on a photo picture. The ink ribbon includes a plurality of sequentially arranged color frames. Each color frame includes a plurality of dye frames with different color dyes and a dye frame with overcoating. A method for generating a dual-thickness overcoating on a photo picture using a thermal printer includes first using the thermal printhead to heat a color frame with a plurality of different color dyes and to sublimate the color dyes on a photo picture. This is followed by using the thermal printhead to heat the dye frame with the overcoating and to heat a different area on the color frame in two distinct time periods.

It is an advantage of the claimed invention that users can use this method to print a variety of pattern images on a photo picture.

These and other objectives of the claimed invention will no doubt become obvious to those of ordinary skill in the art after reading the following detailed description of the preferred embodiment that is illustrated in the various figures and drawings.

BRIEF DESCRIPTION OF DRAWINGS

FIG. 7 is a schematic diagram of a printed letter watermark on a photo picture according to the present invention.

DETAILED DESCRIPTION

The most obvious difference between the present invention and the prior art is that the thermal printhead 12 of the present invention thermal printer will heat a different area of the color frame including the overcoating 26 in two distinct (not only one) time periods by determining sensing voltages generated by the controller 16 of the thermal printer. Therefore, an additional image-shaped thickness of overcoating can be applied to the photo picture.

Figure 1:
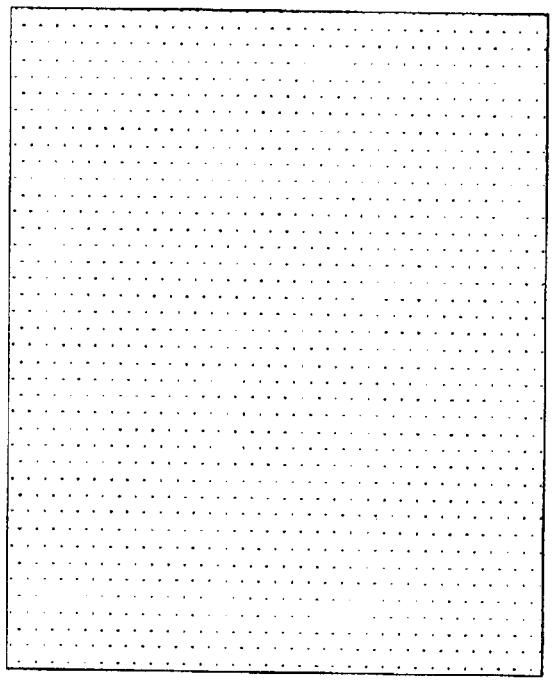
Fig. 1 Prior art
FIG. 1 is a diagram of a pearl photo picture.
Figure 2:
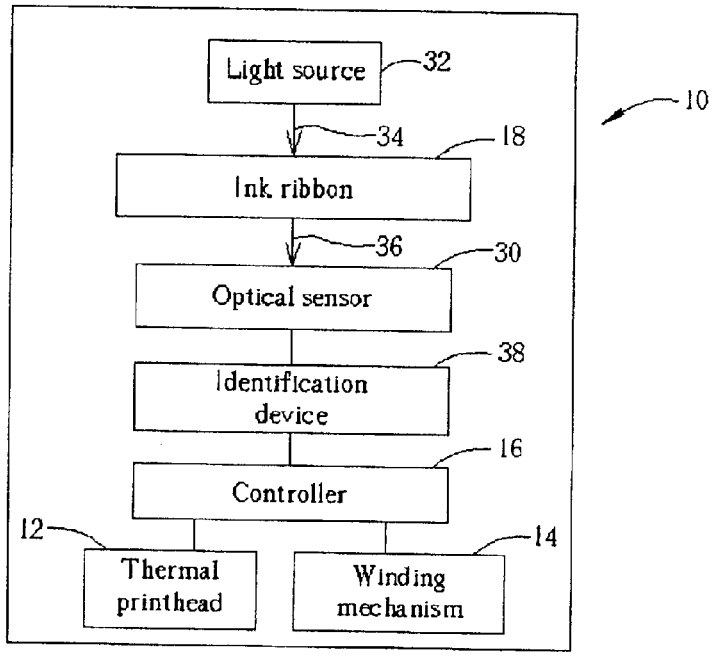
Fig. 2 Prior art
FIG. 2 is a function block diagram of a color frame positioning system of a thermal printer according to a prior art.
Figure 3:
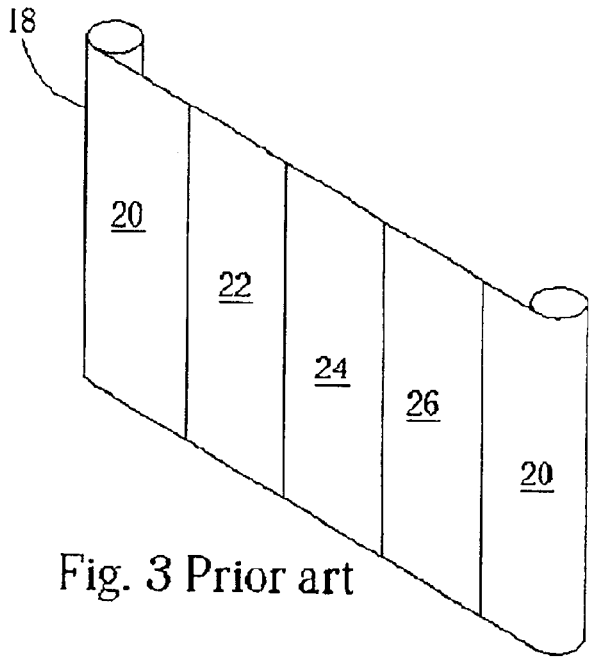
Fig. 3 Prior art
FIG. 3 is a schematic diagram of an ink ribbon of the color frame positioning system shown in FIG. 2.
Figure 4:
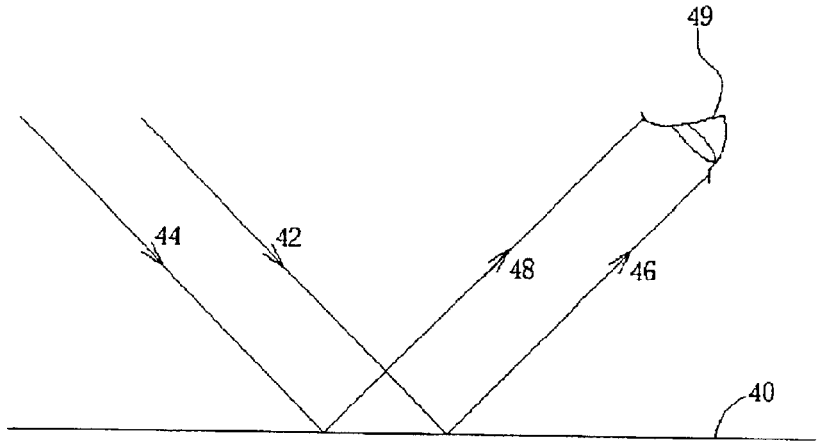
Fig. 4 Prior art
FIG. 4 is a diagram of light beams reflected by a photo picture without an overcoating according to a prior art.
Figure 5:
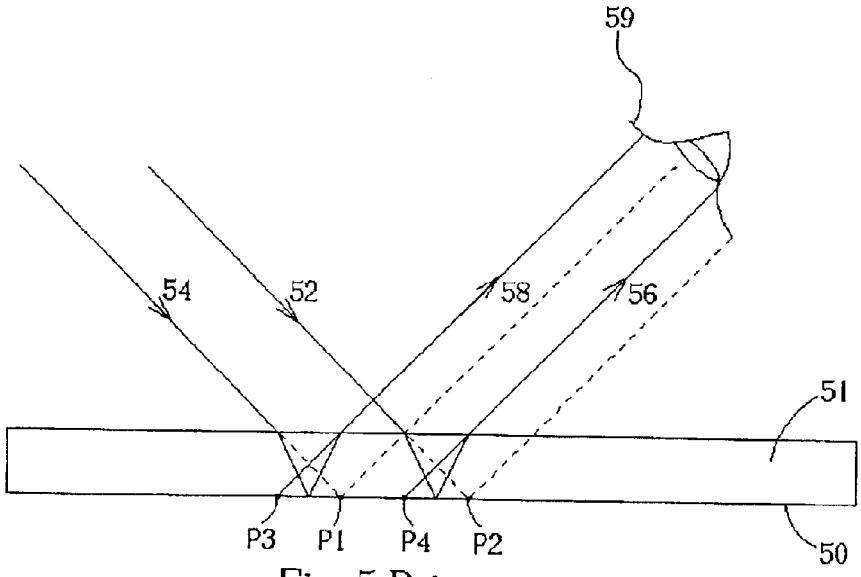
Fig. 5 Prior art
FIG. 5 is a diagram of light beams reflected by another photo picture with a single-thickness overcoating according to a prior art.
Figure 6:
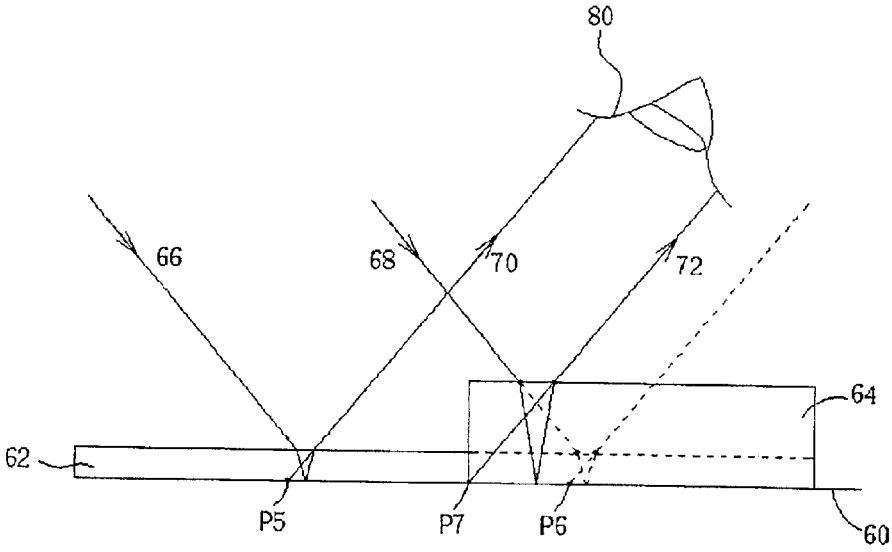
FIG. 6 is a diagram of light beams reflected by a photo picture with a dual-thickness overcoating according to the present invention.

Please refer to FIG. 6. FIG. 6 is a visual effect of the light reflected by a photo picture 60 as seen by eyes 80 with two thicknesses of overcoating. The photo picture 60 is divided into two portions, with a thin overcoating 62 being printed on one portion and a thick overcoating 64 being printed on another portion. A first incident light beam 66 is parallel to a second incident light beam 68 and a first reflected light beam 70 is parallel to a second reflected light beam 72.

A point P5 is perceived by the eyes 80 as the reflecting point for the first incident light beam 66 projected on the photo picture 60 with the thin overcoating 62. A dotted line is the path of a reflected light beam that is projected on the photo picture 60 from the second incident light beam 68 and reflected by the photo picture 60 with a thin overcoating 62. The eyes 80 would normally perceive a point P6 as the reflecting point of the second incident light beam 68 projected on the photo picture 60 with a thin overcoating 62. However, the second reflected light beam 72 is the light that is projected on the photo picture 60 from the second incident light beam 68 and reflected by the photo picture 60 with a thick overcoating 64. A point P7 is perceived by the eyes 80 as the reflecting point of the second incident light beam 68 projected on the photo picture 60 with a thick overcoating 64. The distance between the points P5 and P6 is different from the distance between the points P5 and P7, so P6 is virtually moved to the left. Therefore, the image on the photo picture looks three-dimensional.

Figure 8:
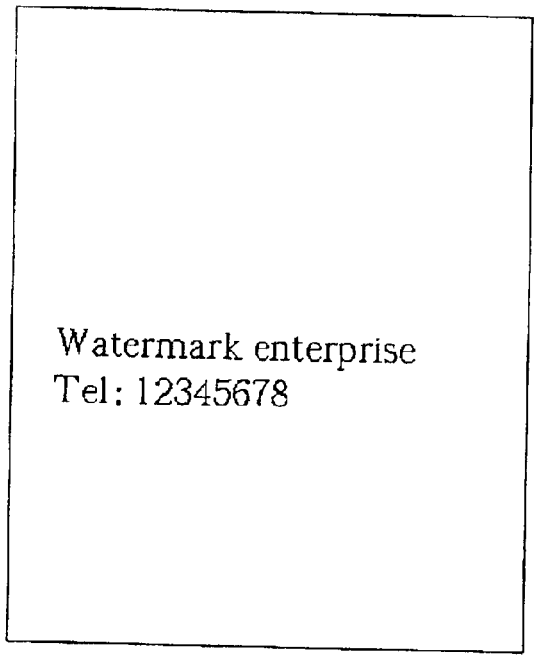
FIG. 8 is a schematic diagram of a special hidden information watermark on a photo picture according to the present invention.
Figure 9:
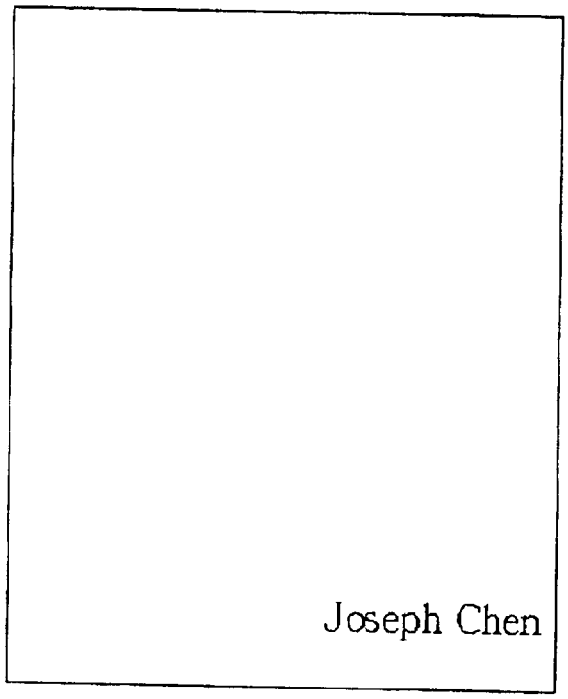
FIG. 9 is a schematic diagram of a signature watermark on a photo picture according to the present invention.
Figure 10:
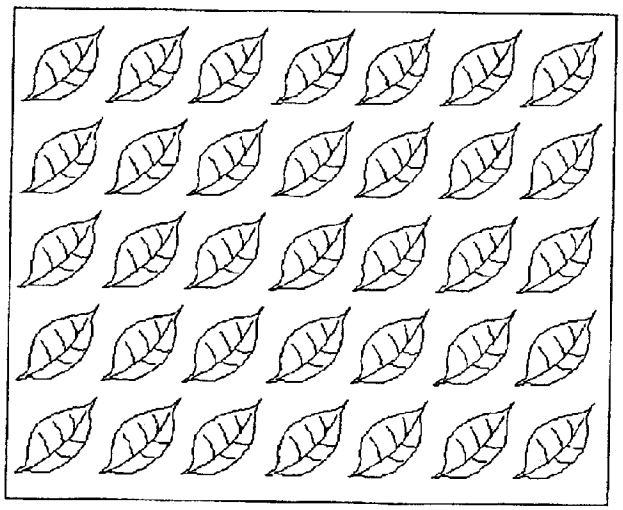
FIG. 10 is a schematic diagram of a special pattern image on a photo picture according to the present invention.

The relationship between light beams with the same incident angles is altered when the light beams project on a photo picture with two different thicknesses of overcoating. When viewed from different angles, the dual-thickness layer of overcoating allows image printed on a photo picture to display a variety of amazing patterns, such as a printed-letter watermark (FIG. 7), a special hidden information watermark (FIG. 8), a signature (FIG. 9), or a special pattern image (FIG. 10).

In contrast to the prior art, the present invention can provide a method for generating a watermark using a thermal printer so that a photo picture printed by a thermal printer enjoys a wider variety of uses.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for generating a watermark on a photo picture using a thermal printer; the thermal printer comprising a thermal printhead for heating an ink ribbon and generating an image through the ink ribbon on a photo picture; the ink ribbon comprising a plurality of sequentially arranged color frames, each color frame comprising a plurality of dye frames with different color dyes and a dye frame with overcoating; the method comprising:

using the thermal printhead to heat a color frame with a plurality of different color dyes and to sublimate the color dyes on a photo picture; and using the thermal printhead to heat at least two different areas of the overcoating dye frame by at least two distinct time periods to dispose overcoating in at least two distinct thicknesses corresponding to the two distinct time periods to form a watermark image over the sublimated colored dye of the photo picture.

2. The method of claim 1 further comprising dividing the photo picture into two portions, wherein thin overcoating is printed on one portion and thick overcoating is printed on another portion to form the watermark image.

3. The method of claim 1 wherein the watermark image is selected from a group consisting of: a printed letter watermark, a hidden information watermark, a signature, and a special pattern.

* * * * *